US011873148B2

(12) United States Patent
Albaum et al.

(10) Patent No.: US 11,873,148 B2
(45) Date of Patent: Jan. 16, 2024

(54) CONTAINER SEAL OVER-PRESSURE VENT MECHANISM

(71) Applicant: PepsiCo, Inc., Purchase, NY (US)

(72) Inventors: Gary Joseph Albaum, Pleasantville, NY (US); William Jack Merrill, Brooklyn, NY (US); Charles Paradise, Brooklyn, NY (US)

(73) Assignee: PepsiCo, Inc., Purchase, NY (US)

( * ) Notice: Subject to any disclaimer, the term of this patent is extended or adjusted under 35 U.S.C. 154(b) by 78 days.

(21) Appl. No.: 17/520,099

(22) Filed: Nov. 5, 2021

(65) Prior Publication Data

US 2022/0144506 A1 May 12, 2022

Related U.S. Application Data

(60) Provisional application No. 63/110,797, filed on Nov. 6, 2020.

(51) Int. Cl.
*B65D 51/16* (2006.01)
*B65D 47/32* (2006.01)
(Continued)

(52) U.S. Cl.
CPC ..... *B65D 51/1661* (2013.01); *B65D 41/0414* (2013.01); *B65D 47/32* (2013.01);
(Continued)

(58) Field of Classification Search
CPC ..... B65D 47/32; B65D 51/1661; B65D 51/1666; A47J 27/09; A47J 27/092
See application file for complete search history.

(56) References Cited

U.S. PATENT DOCUMENTS 4,276,990 A * 7/1981 Chiodo ..... B65D 51/1666 220/203.12
4,592,479 A * 6/1986 Resende ..... A47J 27/09 220/203.12

(Continued)

FOREIGN PATENT DOCUMENTS

DE 3618231 A1 12/1987

OTHER PUBLICATIONS

International Search Report and Written Opinion of the International Searching Authority in International Application No. PCT/US2021/058297, dated Feb. 7, 2022 (9 pages).

*Primary Examiner* — John K Fristoe, Jr.
*Assistant Examiner* — Jennifer Castriotta
(74) *Attorney, Agent, or Firm* — Sterne, Kessler, Goldstein & Fox P.L.L.C.

(57) ABSTRACT

A container assembly includes a vessel and a lid removably coupled to the vessel. The lid includes a circumferential rim at an interface with the vessel, wherein the rim is separated from the vessel by a gap, wherein the gap is open to the atmosphere outside the container. The container includes a gasket disposed at a sealing position between the lid and the vessel to seal a reservoir of the vessel from the gap. The rim includes a recess extending circumferentially along a first portion of the rim. The recess forms a portion of the gap and defines a venting zone extending circumferentially along the first portion of the rim. In response to the internal reservoir of the vessel reaching a threshold pressure, a portion of the gasket moves from the sealing position through the gap such that fluid held in the reservoir is vented past the gasket through the venting zone to reduce the pressure of the reservoir.

20 Claims, 16 Drawing Sheets

(51) Int. Cl.
*B65D 41/04* (2006.01)
*B65D 25/54* (2006.01)

(52) U.S. Cl.
CPC ..... *B65D 25/54* (2013.01); *B65D 2205/02* (2013.01); *B65D 2251/0015* (2013.01); *B65D 2251/0078* (2013.01); *B65D 2251/0087* (2013.01); *B65D 2251/20* (2013.01)

(56) References Cited

U.S. PATENT DOCUMENTS

| | | | |
|---|---|---|---|
| 10,517,436 | B2 | 12/2019 | Arnett et al. |
| 2007/0028780 | A1 | 2/2007 | Popeil et al. |
| 2009/0101643 | A1 | 4/2009 | Rhetat et al. |

* cited by examiner

CONTAINER SEAL OVER-PRESSURE VENT MECHANISM

CROSS-REFERENCE TO RELATED APPLICATIONS AND INCORPORATION BY REFERENCE

This application claims priority to U.S. Provisional Patent Application No. 63/110,797 filed on Nov. 6, 2020, which is incorporated by reference herein in its entirety for all purposes.

BACKGROUND

Field

The present disclosure relates to a multi-piece container for holding carbonated liquid, more specifically, to seal interfaces between components of the container.

Background

Carbonated beverages such as sparkling water, are becoming increasingly popular with consumers. Typically, carbonated beverages are prepared at a factory and distributed in disposable bottles or cans to stores. Preparation and distribution of the carbonated beverages in disposable bottles or cans may increase costs for consumers and result in more waste. Accordingly, consumers may desire preparing carbonated beverages using their own carbonation system and storing the carbonated beverages in their own reusable bottle that is operatively compatible with the carbonation system.

Bottles used for carbonation typically consist of a single-piece configuration. However, a single-piece configuration does not allow for the bottle to be easily cleaned or for ice to be added in the container of the bottle. On the other hand, multi-piece drinking bottles are typically not configured to withstand the pressure required to be compatible with a carbonator. There is a need for multi-piece reusable bottles that can be used with carbonators, while having improved integrity and safety measures that effectively vent fluid to relieve excessive pressure buildups.

BRIEF SUMMARY

The present disclosure includes various embodiments of a container.

In some embodiments, a container comprises a vessel and a lid removably coupled to the vessel. In some embodiments, the lid comprises a circumferential rim at an interface with the vessel. In some embodiments, the rim is separated from the vessel by a gap. In some embodiments, the gap is open to the atmosphere outside the container. In some embodiments, the container comprises an annular gasket disposed at a sealing position between the vessel and the lid to seal an internal reservoir of the vessel from the gap. In some embodiments, in response to the internal reservoir of the vessel reaching a threshold pressure, a portion of the gasket moves from the sealing position through the gap such that fluid (e.g., gas or liquid) held in the reservoir is vented through the gap to reduce the pressure of the reservoir.

In some embodiments, the rim comprises a recess extending circumferentially along a first portion of the rim. In some embodiments, the recess forms a portion of the gap and defines a venting zone extending circumferentially along the first portion of the rim. In some embodiments, the portion of the gasket is located along the venting zone such that the fluid vented through the gap is directed through the venting zone.

In some embodiments, the recess comprises a first end located forward of an inner edge of the rim and a second end located at an outer edge of the rim. In some embodiments, the recess has a first height proximate to the first end and a second height proximate to the second end, and the second height is greater than the first height.

In some embodiments, in response to the internal reservoir of the vessel reaching the threshold pressure, a second portion of the gasket remains in the sealed position along a second portion of the rim to maintain the seal between the reservoir of the vessel and the gap along the second portion of the rim.

In some embodiments, the lid comprises an upper sidewall and a lower sidewall defining a chamber, and the rim extends in a radial direction from the lower sidewall to the upper sidewall. In some embodiments, the upper sidewall extends above the vessel sidewall and the lower sidewall projects into the vessel such that the chamber of the lid opens into the reservoir of the vessel.

In some embodiments, the lower sidewall comprises a helical-shaped thread configured to engage a sidewall of the vessel, and the thread includes a plurality of breaks defining a fluid passage aligned with the recess of the rim.

In some embodiments, the vessel is comprised of stainless steel, and the lid is comprised of a polymer-based material. In some embodiments, the polymer-based material is transparent.

In some embodiments, a container comprises a vessel and a lid removably coupled to the vessel. In some embodiments, the lid comprises a circumferential rim at an interface with the lid. In some embodiments, the rim is separated from the vessel by a gap. In some embodiments, the gap is open to the atmosphere outside the container. In some embodiments, the container comprises an annular gasket disposed at a sealing position between the vessel and the lid to seal an internal reservoir of the vessel from the gap. In some embodiments, in response to the internal reservoir of the vessel reaching a threshold pressure, a portion of the gasket moves from the sealing position through the gap along the venting zone such that fluid held in the reservoir is vented through the gap to reduce the pressure of the reservoir.

In some embodiments, the interface defines a venting zone extending circumferentially along a first portion of the interface and a non-venting zone extending circumferentially along a second portion of the interface. In some embodiments, the gap along the venting zone is greater in a vertical direction than the gap along the non-venting zone. In some embodiments, the portion of the gasket is located along the venting zone such that the fluid vented through the gap is directed through the venting zone.

In some embodiments, the lid comprises an upper sidewall and a lower sidewall defining a chamber, and the rim extends in a radial direction between the upper sidewall and the lower sidewall. In some embodiments, the upper sidewall extends above the vessel sidewall and the lower sidewall projects into the vessel such that the chamber of the lid opens into the reservoir of the vessel.

In some embodiments, the lower sidewall comprises a helical-shaped thread configured to engage a sidewall of the vessel, and the thread includes a plurality of breaks defining a fluid passage. In some embodiments, the breaks are aligned with the venting zone.

In some embodiments, the rim comprises a recess located along the venting zone of the interface, and the recess comprises a first end located forward of an inner edge of the rim and a second end located at an outer edge of the rim. In some embodiments, the recess has a first height proximate to the first end and a second height proximate to the second end, and the second height is greater than the first height.

In some embodiments, wherein in response to the internal reservoir of the vessel reaching the threshold pressure, a second portion of gasket remains in the sealed position along the non-venting zone of the interface to maintain the seal between the reservoir of the vessel and the gap along the non-venting zone.

In some embodiments, the vessel comprises a bottom and a vessel sidewall extending from the bottom defining the reservoir. In some embodiments, an upper end of the vessel sidewall comprises a recess located along the venting zone of the interface, and the recess comprises a first end located forward of an interior surface of the vessel sidewall and a second end located at an exterior surface of the vessel sidewall. In some embodiments, the recess has a first height proximate to the first end and a second height proximate to the second end, and the second height is greater than the first height.

In some embodiments, the vessel is comprised of a metal-based material, and the lid is comprised of a polymer-based material. In some embodiments, the polymer-based material is transparent.

BRIEF DESCRIPTION OF THE DRAWINGS

The accompanying drawings, which are incorporated herein and form a part of the specification, illustrate the embodiments and, together with the description, further serve to explain the principles of the embodiments and to enable a person skilled in the relevant art(s) to make and use the embodiments.

Figure 1:
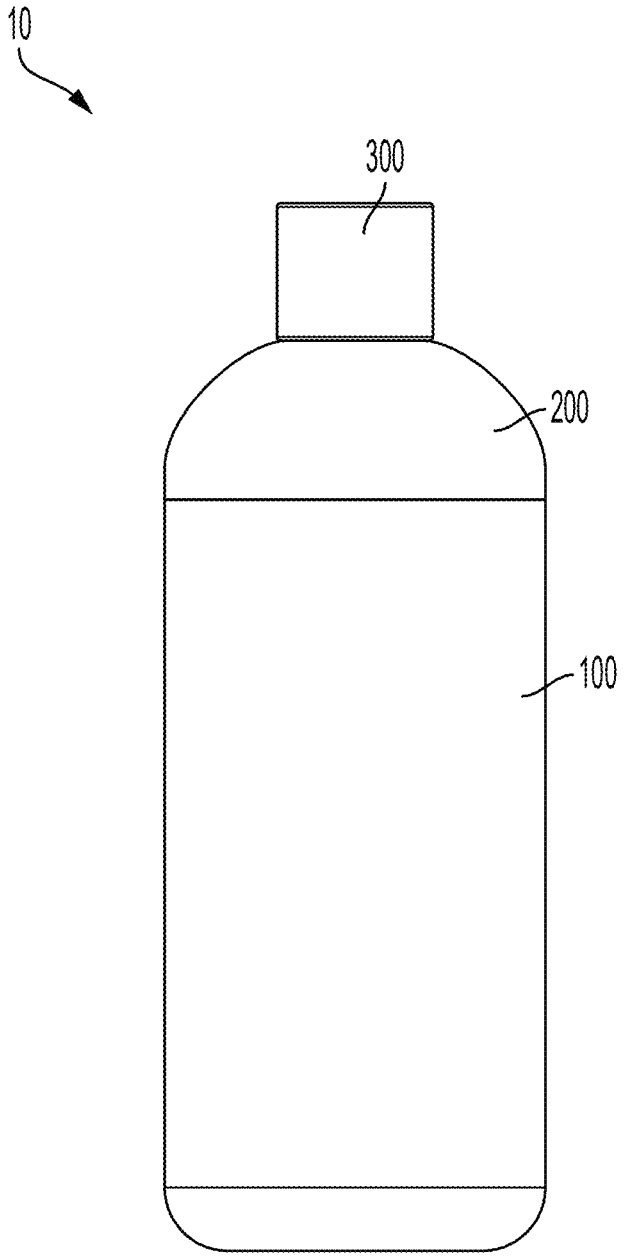
FIG. 1 is a side view of a container.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Compared to disposable bottles and cans, reusable bottles possess more rigid materials and container walls having thicker dimensions. Moreover, reusable bottles may feature a multiple piece assembly to facilitate cleaning of the bottle and filling the bottle with ice.

Some in-home systems allow a user to carbonate a beverage within a reusable bottle. This may involve introducing carbonation at controlled pressures into the bottle to reach a target pressure for carbonation within the beverage contained in the bottle. Such systems typically have safeguards to prevent overpressurization of the bottle. As shown in embodiments described herein, internal pressure of the bottle can also be managed by the bottle itself, to thereby provide an overpressurization safeguard independent from the carbonation system itself. As described in more detail below, such pressure management can be easy to implement and reusable (e.g., without involving additional dedicated or single-use components).

According to various embodiments described herein, the container of the present disclosure may include a vessel and a lid removably coupled to the vessel. The lid can include a circumferential rim at an interface with the vessel, in which the rim is separated from the vessel by a gap that is open to the atmosphere outside the container. The container can include an annular gasket disposed at a sealing position between the vessel and the lid to seal an internal reservoir of the vessel from the gap. The interface can define a venting zone extending circumferentially along a first portion of the interface and a non-venting zone extending circumferentially along a second portion of the interface. The height of portions of the gap along the venting zone can be larger than the gap along the non-venting zone. In response to a reservoir of the vessel reaching a threshold pressure, a portion of the gasket can move from the sealing position through the gap along the venting zone. As the gasket moves out of the sealing position, fluid communication is established between the venting zone defined by the interface and the reservoir of the vessel so that fluid (e.g., gas or liquid) held in the reservoir is vented past the gasket through the venting zone to reduce the internal pressure of the container. At the same time, a second portion of the gasket remains in the sealing position along the non-venting zone to maintain the seal between the reservoir of the vessel and the gap along the non-venting zone. Accordingly, the pressure is relieved from the container in a controlled manner, thereby maintaining the structural integrity of the container.

In some embodiments, the vessel can include a bottom and a vessel sidewall defining the reservoir for holding a fluid. The rim can be aligned with an upper end of the vessel sidewall such that a height of the gap is defined between the rim of the lid and the upper end of the vessel sidewall. In some embodiments, the geometry of the rim can enlarge the height of the gap along the venting zone to weaken the seal between the gasket and the corresponding portions of the rim and the upper end of the vessel sidewall, thereby allowing the gasket to move into the gap along the venting zone to relieve pressure before the internal pressure of the vessel reaches an unacceptably high level (e.g., a level that could risk damaging the container).

In some embodiments, the lid can define an upper lid opening disposed above the rim and configured to interface with a carbonation system to inject gas (e.g., carbon dioxide) into the reservoir of the vessel. Unlike bottle cap seals, the gasket can remain in the sealing position between the vessel and the lid as the carbonation system injects gas into the reservoir of the vessel. If the pressure of the reservoir reaches above the threshold pressure as gas is injected into the reservoir of the vessel, the portion of the gasket along the venting zone can move from the sealing position through the gap to relieve pressure buildup in the vessel. When the lid is operatively connected to the carbonation system, the position of the venting zone along the circumference of the bottle can be directed to outflow fluid away from a user filling the container with a carbonator.

Figure 2:
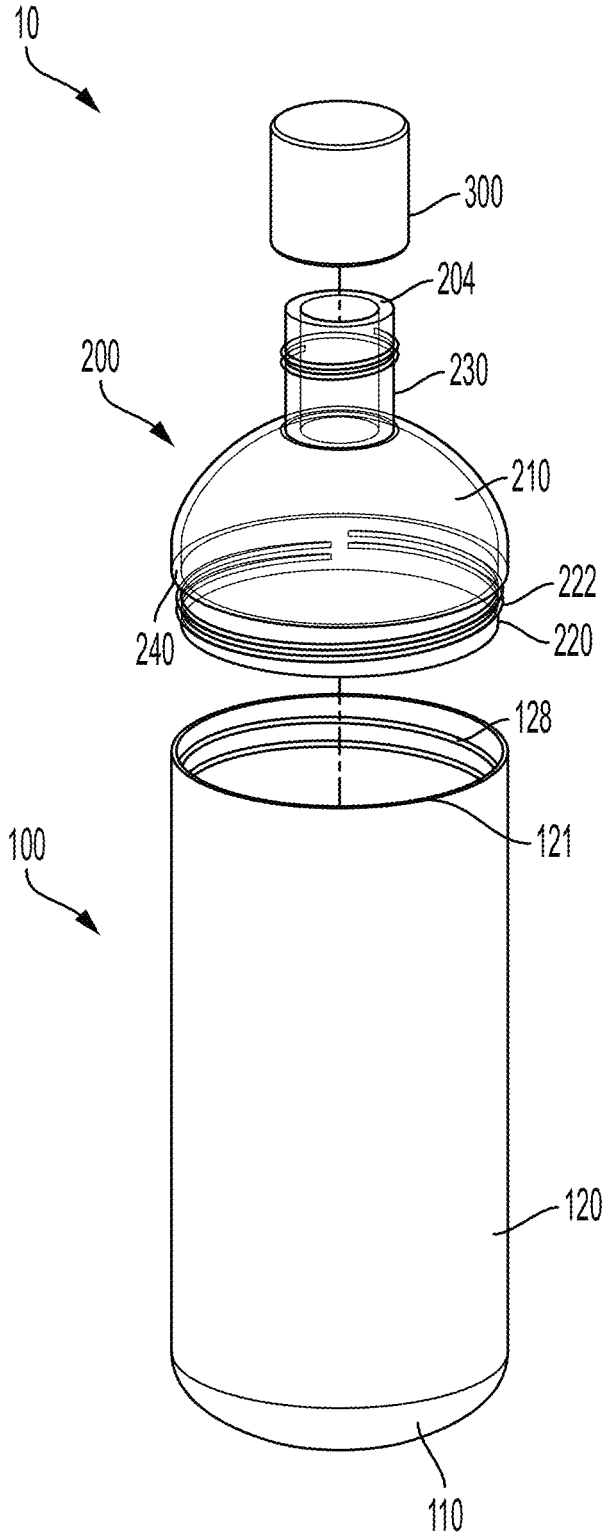
FIG. 2 is an exploded view of the container shown in FIG. 1.

Embodiments will now be described in more detail with reference to the figures. With reference to FIGS. 1 and 2, for example, in some embodiments, a container 10 can include a vessel 100, a lid 200, and a cap 300. In some embodiments, vessel 100 can be configured to hold a fluid, such as, for example, a carbonated beverage. Lid 200 can be configured to be removably coupled to vessel 100 such that lid 200 contains fluid held in vessel 100. Lid 200 can include a lid opening 204 to dispense fluid in and out of vessel 100. Cap 300 can be removably coupled to lid 200 to enclose lid opening 204, thereby sealing fluid held collectively by vessel 100 and lid 200.

In some embodiments, vessel 100 can be formed of one or more metal-based materials. For example, vessel 100 can be formed of stainless steel, titanium, aluminum, galvanized tin, chrome, or any other suitable metal alloy. In some embodiments, vessel 100 can be constructed from any suitable metal processing, such as, for example, rolling, stamping, casting, molding, drilling, grinding, or forging.

In some embodiments, vessel 100 can include a bottom 110 and a vessel sidewall 120 extending from bottom 110 to define a reservoir 102 for holding a liquid, such as a beverage. Vessel sidewall 120 can include an upper end 121 defining an opening into reservoir 102. Vessel sidewall 120 can be substantially cylindrical in shape and symmetrical about a central longitudinal axis. In some embodiments, vessel sidewall 120 can define other shapes (e.g., bulging or rounded edges). Vessel 100 may be configured to hold a carbonated beverage at a pressure above atmospheric pressure (e.g., internal pressure between 70 PSI and 120 PSI). Vessel sidewall 120 can include ribs or other types of protrusions extending radially away and in an axial direction to promote gripping by a user.

Figure 4:
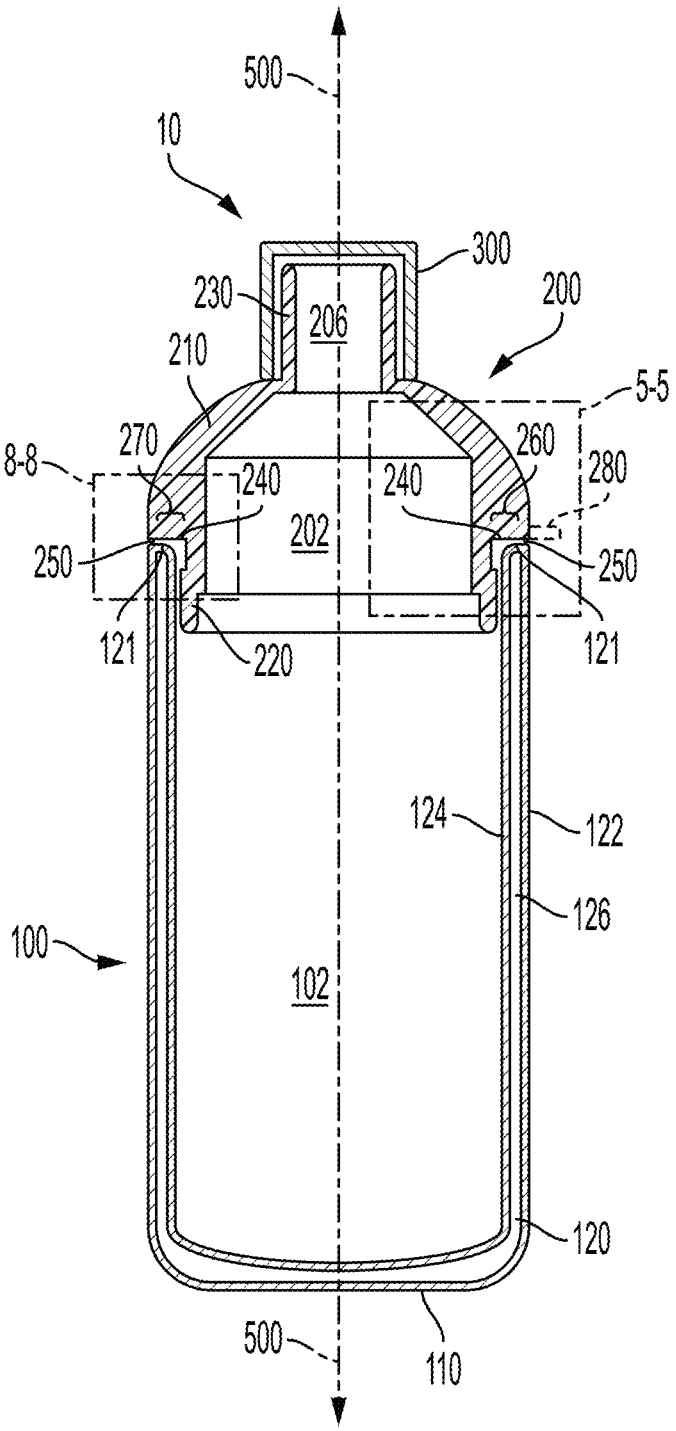
FIG. 4 is a cross-sectional view of the container taken along a central longitudinal axis 500 of the container shown in FIG. 1.
Figure 5:
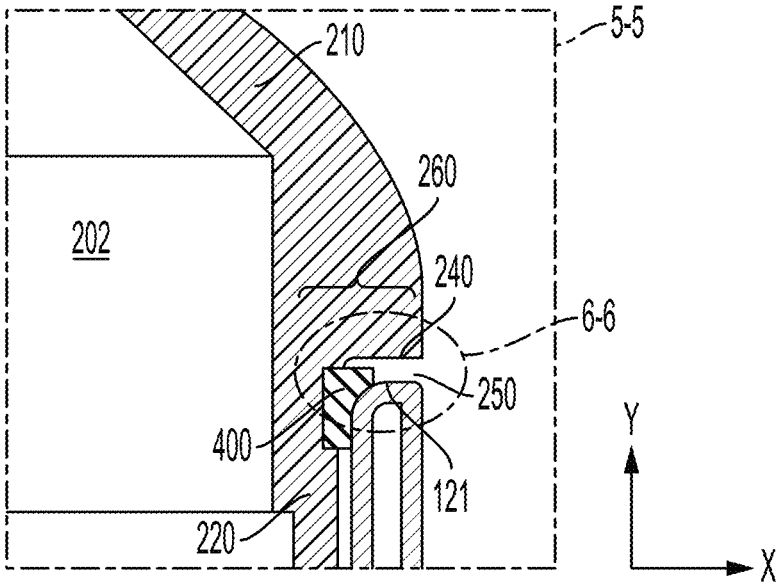
FIG. 5 is an enlarged cross-sectional view of a venting zone interface between a lid and a vessel taken along broken line 5-5 of FIG. 4.

Referring to FIG. 4, for example, in some embodiments, vessel sidewall 120 can include an exterior sidewall 122 defining an exterior surface of vessel sidewall 120 and an interior sidewall 124 defining an interior surface of vessel sidewall 120. Interior sidewall 124 and exterior sidewall 122 can be disposed concentrically about a central longitudinal axis. Exterior sidewall 122 and interior sidewall 124 can be spatially separated by an insulation gap 126 to inhibit heat transfer between reservoir 102 and the ambient air surrounding vessel 100. In some embodiments, gap 126 can define a sealed vacuum. In some embodiments, gap 126 can be filled with air. In some embodiments, gap 126 can be filled with insulating material, such as a polymer material or a polymer foam material, to lower heat conductivity between exterior sidewall 122 and interior sidewall 124.

In some embodiments, vessel sidewall 120 can include a connection interface for engaging lid 200 to secure lid 200 to vessel 100. For example, vessel sidewall 120 can include a thread 128 winding helically along the interior surface of interior sidewall 124. Thread 128 can be disposed proximate to upper end 121 of vessel sidewall 120 to engage a corresponding a thread of lid 200.

In some embodiments, vessel 100 can be configured to hold a liquid volume of fluid in a range between 450 ml and 550 ml, such as at about 500 ml or 18 fluid ounces. The dimensions of bottom 110 and vessel sidewall 120 can be modified to vary the volume of fluid held in reservoir 102. For example, vessel sidewall 120 can include a transverse dimension (e.g., internal diameter) in a range between 65 mm and 85 mm, such as from 72 mm to 75 mm. In some embodiments, the internal diameter of vessel sidewall 120 can range from 78 mm to 85 mm. In some embodiments, vessel sidewall 120 can include a height in a range between 170 mm to 220 mm, such as about 200 mm. These ranges of transverse dimensions configure vessel 100 to limit reaction forces applied from containing a carbonated beverage while holding a sufficient volume of fluid in container 10.

In some embodiments, lid 200 can be formed of a polymer-based material. For example, lid 200 can be formed of a copolyester such as Tritan, polyethylene terephthalate (PET), polyethylene naphthalate (PEN), polyethylene furanoate (PEF), or any other suitable polymer.

In some embodiments, lid 200 may be transparent (e.g., the polymer-based material used for forming lid 200 can be transparent) such that chamber 202 and at least a portion of reservoir 102 is visible to a user when lid 200 is secured to vessel 100. In the context of the present disclosure, transparent can include various degrees of transparency, including being tinted with any combination of colors. The visibility of the interior of container 10 aids the user in filling the container 10 with a liquid beverage or a carbonated fluid, and provides a way for the user to view the carbonation process when the bottle is connected to a carbonation system or gauge the filling from a food service fountain of pre-carbonated liquid to control overflow. The transparent polymer-based material can also promote visual aesthetic appeal of the container 10.

In some embodiments, lid 200 can be formed of a metal-based material, such as the same material used to form vessel 100. For example, lid 200 can be formed out of stainless steel.

Figure 3:
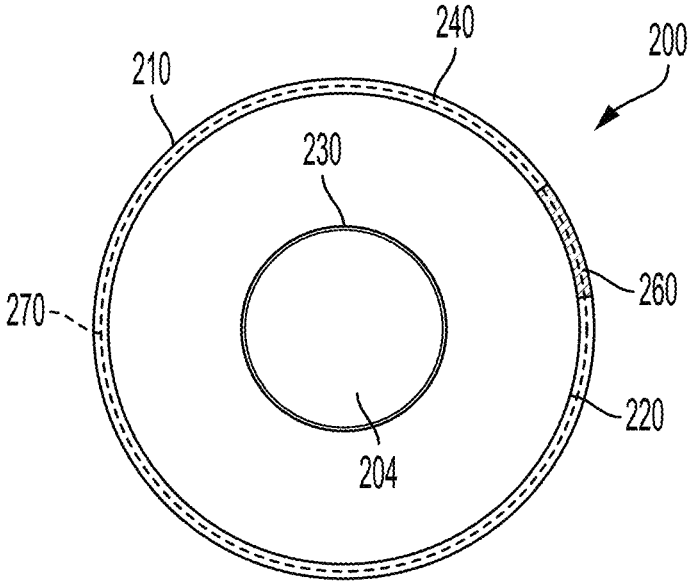
FIG. 3 is a bottom view of a lid for the container shown in FIG. 1.

In some embodiments, as shown in FIGS. 2 and 3, for example, lid 200 can include an upper sidewall 210 and a lower sidewall 220. As shown in FIG. 4, upper sidewall 210 and lower sidewall 220 collectively define a chamber 202. Upper sidewall 210 can have a substantially dome shape, whereby a diameter of a lower portion of upper sidewall 210 is larger than a diameter of an upper portion of upper sidewall 210. In some embodiments, upper sidewall 210 can have other shapes (e.g., rounded or bulged edges). Lid 200 can be configured to contain a carbonated beverage at applied pressures between 70 PSI and 120 PSI.

In some embodiments, lower sidewall 220 can be substantially cylindrical in shape and symmetrical about a central longitudinal axis 500. Once lid 200 is secured to vessel 100, lower sidewall 220 can be disposed concentrically with respect to vessel sidewall 120. Lower sidewall 220 can include a connection interface configured to engage the interior surface of vessel sidewall 120 to secure lid 200 to vessel 100. For example, as shown in FIG. 2, lower sidewall 220 can include a thread 222 winding helically along the exterior surface of lower sidewall 220 to engage thread 128 of vessel sidewall 120. Once lower sidewall 220 is threadably engaged with vessel sidewall 120 as shown in FIG. 4, upper sidewall 210 can extend above vessel sidewall 120 and lower sidewall 220 can project into the vessel 100 such that chamber 202 of lid 200 opens into reservoir 102 of vessel 100.

Figure 11:
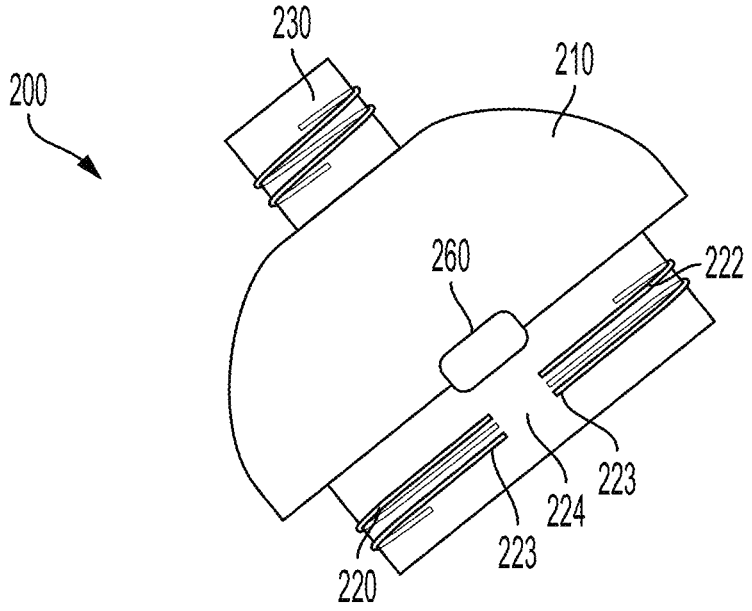
FIG. 11 is a perspective view of a lid for a container shown in FIG. 1.
Figure 13:
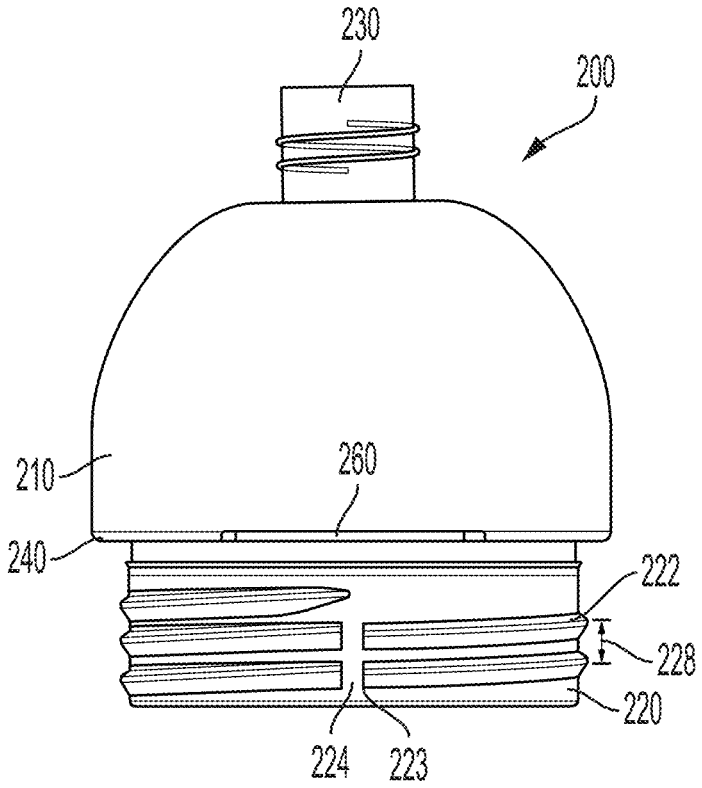
FIG. 13 is a side view of a lid for a container shown in FIG. 1.

The length of thread 128 and/or thread 222 can be tuned to adjust the seal strength of the connection interface between the interior surface of vessel sidewall 120 and the exterior surface of the lower sidewall 220. For example, thread 222 can wind multiple turns along the exterior surface of lower sidewall 220, such as at least 720 degrees (e.g., two revolutions) along the exterior surface of lower sidewall 220. In some embodiments, thread 222 can wind multiple turns along the exterior surface of lower sidewall 220 as a continuous thread without any breaks. In some embodiments, thread 222 can wind multiple turns along the exterior surface of lower sidewall 220 with breaks 223, as shown in FIGS. 11 and 13. In another example, the length of thread 222 can be limited such that thread 222 winds no more than 360 degrees (e.g., one revolution) along the exterior surface of lower sidewall 220. Increasing the length of the thread 128 and/or thread 222 increases the seal strength of the connection interface between the interior surface of vessel sidewall 120 and the exterior surface of the lower sidewall 220.

The pitch between adjacent turns of thread 128 and/or thread 222, such as the pitch 228 shown in FIG. 13, can be tuned to adjust the seal strength of the connection interface between the interior surface of vessel sidewall 120 and the exterior surface of the lower sidewall 220. The pitch between adjacent turns of thread 128 and/or thread 222 can range from 2 mm to 8 mm, such as from 4 mm to 6 mm.

Figure 12:
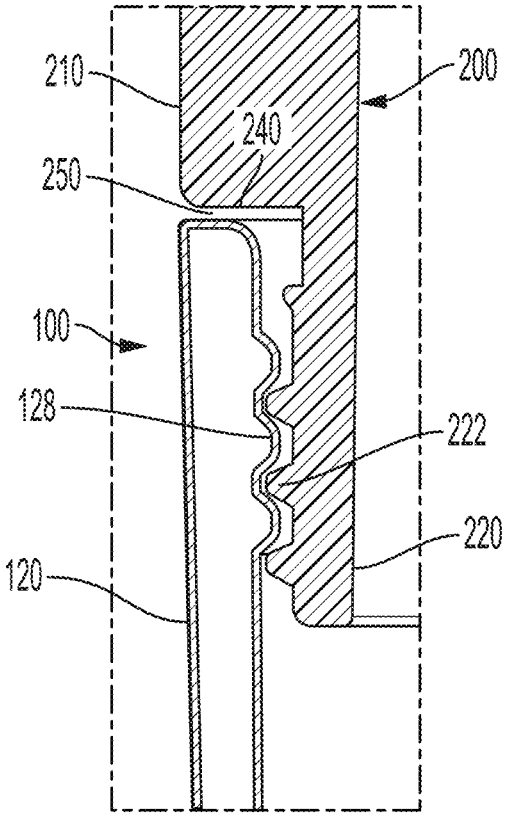
FIG. 12 is an enlarged cross-sectional view of a connection interface between a sidewall of a vessel and a lower sidewall of a lid shown in FIG. 11.
Figure 14:
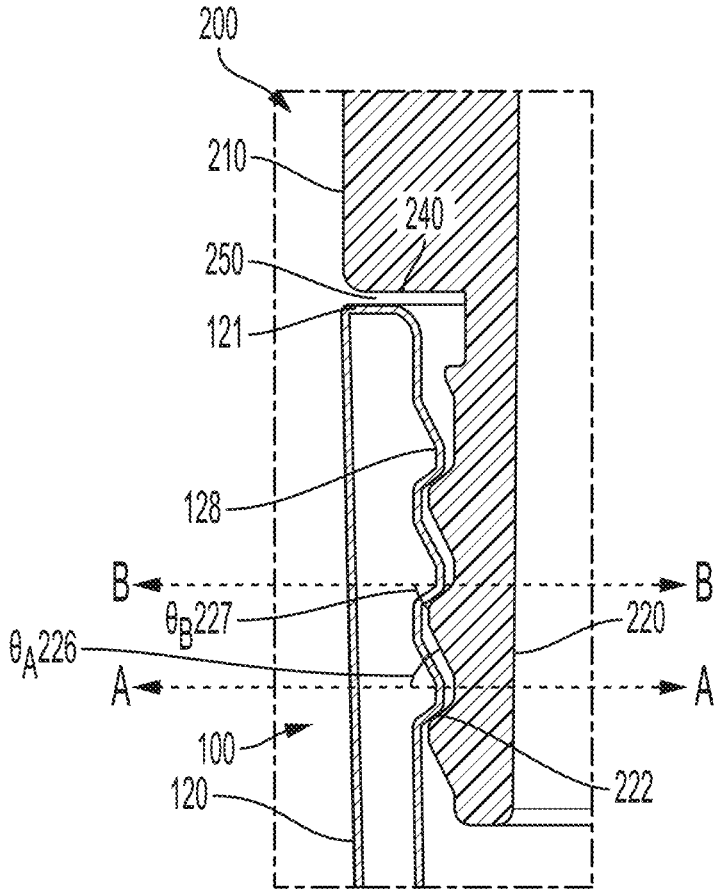
FIG. 14 is an enlarged cross-sectional view of a connection interface between a sidewall of a vessel and a lower sidewall of a lid shown in FIG. 13.

The profile of thread 128 and/or thread 222 can be tuned to adjust the seal strength of the connection interface between the interior surface of vessel sidewall 120 and the exterior surface of the lower sidewall 220. For example, as shown in FIG. 12, the profile of thread 128 and/or thread 222 each can have a symmetrical shape such that the upper and lower sides of thread 128 and thread 222 are inclined at a same angle relative to a plane extending orthogonal to central longitudinal axis 500. In some embodiments, as shown in FIG. 14, the profile of thread 222 can have an asymmetrical shape such that the upper and lower sides are inclined at different angles relative to a plane extending orthogonal to central longitudinal axis 500. For example, thread 222 can have a lower side 226 inclined at a first angle $\theta_A$ relative to a plane A extending orthogonal to central longitudinal axis 500 and an upper side 227 inclined at a second angle $\theta_B$ relative to a plane B extending orthogonal to central longitudinal axis 500, where the first angle $\theta_A$ is greater than the second angle $\theta_B$. The asymmetrical profile of thread 222 shown in FIGS. 13 and 14 promotes greater contact force against thread 128 of vessel sidewall 120 and increases the contact surface area between thread 128 and thread 222, thereby increasing the seal strength of the connection interface between the interior surface of vessel sidewall 120 and exterior surface of lower sidewall 220. Tuning the length, the pitch, and the profile of thread 128 and/or thread 222 to increase the seal strength of the connection interface configures the lid 200 to remain secure to the vessel 100 even when the internal pressure of vessel 100 reaches an undesirably high level (e.g., 115 PSI to 145 PSI).

In some embodiments, lid 200 can include a neck 230 projecting from an upper end of upper sidewall 210. Neck 230 can be substantially cylindrical shape and symmetrical about a central longitudinal axis. In some embodiments, neck 230 can define a passage 206 opening into chamber 202. Neck 230 can define lid opening 204 that may interface with a carbonation system to inject gas (e.g., carbon dioxide) into reservoir 102 of vessel 100.

In some embodiments, neck 230 includes a height suitable for providing a seat for a user's lower lip during drinking. The upper end of neck 230 can support the user's lip while the user drinks fluid held in reservoir 102 of vessel 100.

In some embodiments, neck 230 can include engaging connection interface configured to engage cap 300 such that cap 300 is secured to lid 200. For example, neck 230 can include a thread winding helically along the exterior surface of neck 230 to engage cap 300. Neck 230 can include other structures, such as a flange, for engaging cap 300 or other components associated with a carbonation system.

In some embodiments, lid 200 can be configured to contain a volume in a range up to between 140 ml and 180 ml, such as at about 160 ml, along chamber 202. The dimensions of upper sidewall 210 and lower sidewall 220 can be modified to vary the volume of fluid contained in chamber 202. For example, lid 200 can include a transverse dimension (e.g., internal diameter) in a range between 60 mm and 80 mm. Lid 200 can include a height in a range between 20 mm and 100 mm. Upper sidewall 210 can include a transverse dimension (e.g., thickness) in a range between 4 mm and 8 mm, such as for example, at about 6 mm. These ranges of transverse dimensions can help allow lid 200 to provide sufficient headspace for carbonation or shaking to mix concentrate. These ranges of transverse dimensions help allow lid 200 to maintain sufficient vertical height and volume between the liquid fill line within vessel 100 and internal components of the carbonation system disposed above the lid during the carbonation process (e.g., overpressure valves). This can help keep any carbonation upswell during the carbonation process from contacting the components of the carbonation system, while still allowing the carbonator wand of the carbonation system to extend below the liquid fill line.

Referring to FIGS. 3-9, lid 200 can include a circumferential rim 240 extending in a radial direction between upper sidewall 210 and lower sidewall 220. Rim 240 can include a shape corresponding to the shape of upper end 121 of vessel sidewall 120. For example, rim 240 can be annular-shaped to correspond to a cylindrical-shaped vessel sidewall 120 such that rim 240 is aligned with upper end 121 of vessel sidewall 120 when lid 200 is secured to vessel 100. When lid 200 is secured to vessel 100 (e.g., lower sidewall 220 is threadably engaged with vessel sidewall 120), rim 240 can be spatially separated from upper end 121 of vessel sidewall 120 by a gap 250 (see, e.g., FIGS. 5-9). Gap 250 can extend along the entire circumference of vessel 100 and lid 200 to define a spatial interface along the perimeter between rim 240 of lid 200 and upper end 121 of vessel sidewall 120.

In some embodiments, lid 200 may include a carbonator alignment feature to facilitate alignment and placement with a carbonation system. The carbonator alignment feature can include a protrusion 280 projecting in a radial direction from rim 240. Protrusion 280 can be disposed along a portion of the rim 240 (e.g., venting zone 260) that is configured to permit movement of a gasket (e.g., gasket 400) when pressure in reservoir 102 reaches above a threshold pressure level to relief pressure in reservoir 102. In use, a user may align protrusion 280 toward their carbonator system (away from the user) so that protrusion 280 can engage with features of the carbonator system to activate the system.

Container 10 further includes a gasket 400 fitted between vessel sidewall 120 and lid 200 when coupled to vessel 100 such that gasket 400 seals reservoir 102 from gap 250 (e.g., hermetically seals an interface between vessel 100 and lid 200). Gasket 400 can be formed of an elastically compressible material, such as, for example, silicone rubber or a silicone-based material. In the context of the present disclosure, a compressible material refers to a material that can be elastically strained, thinned, or deformed by application of a compressive force and substantially returns to its previous configuration upon removal of the compressive force.

Figure 6:
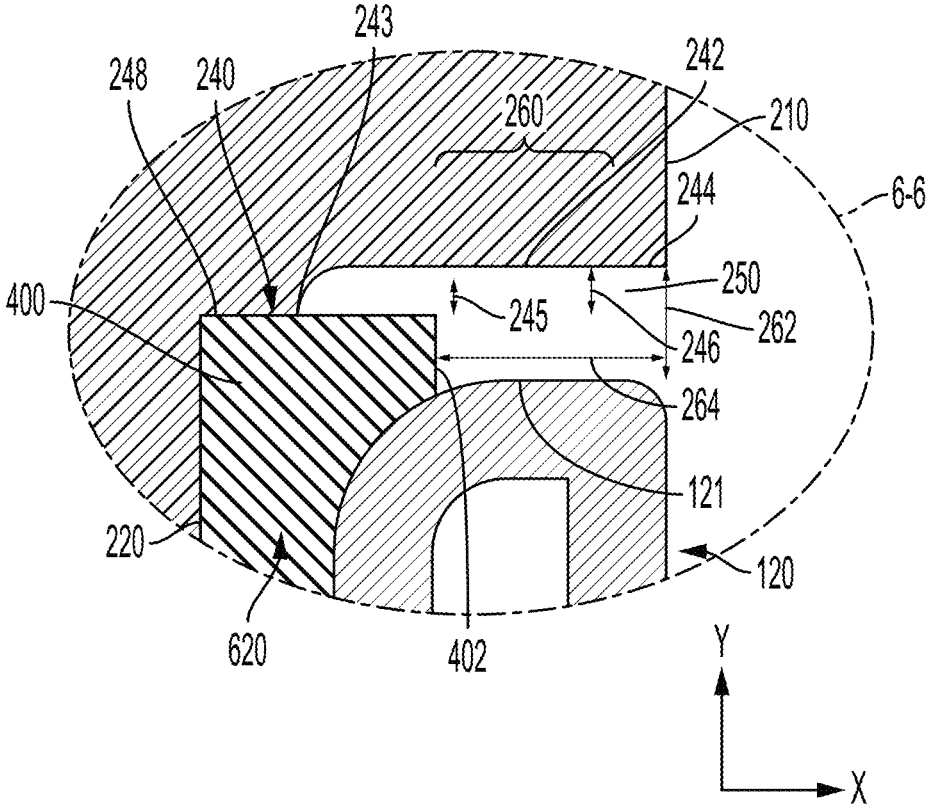
FIG. 6 is an enlarged cross-sectional view of a venting zone interface between the lid and the vessel taken along broken line 6-6 of FIG. 5.
Figure 9:
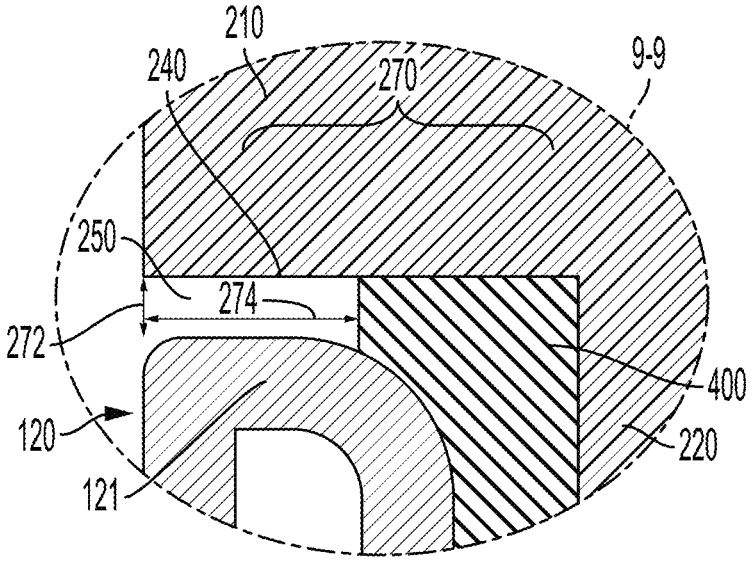
FIG. 9 is an enlarged cross-sectional view of a non-venting zone interface between the lid and the vessel taken along broken line 9-9 of FIG. 8.

In some embodiments, when lid 200 is secured to vessel 100, gasket 400 may be disposed at a sealing position, where gasket 400 seals reservoir 102 from gap 250. Gap 250 may be open to the atmosphere outside reservoir 102. As shown in FIGS. 6 and 9, for example, the sealing position of gasket 400 may be located between an intersection of lower sidewall 220 and rim 240 of lid and an intersection of interior surface of vessel sidewall 120 and upper end 121 of vessel sidewall 120. At the sealing position, gasket 400 can extend in a vertical direction Y (e.g., an axial direction) between a portion of lower sidewall 220 and a portion of the interior surface of vessel sidewall 120. At the sealing position, gasket 400 can extend in a lateral direction X (e.g., radial direction) between a portion of upper end 121 of vessel sidewall 120 and a portion of rim 240. As shown in FIGS. 6 and 9, for example, when gasket 400 is fitted between lid 200 and vessel sidewall 120, gap 250 extends laterally in a radial direction from a seal edge 402 of gasket 400 to upper sidewall 210 and exterior surface of vessel sidewall 120. In some embodiments, a length of gap 250 in a radial direction can range from 1.5 mm to 2.0 mm, such as for example, having a radial length at about 1.75 mm.

Figure 15:
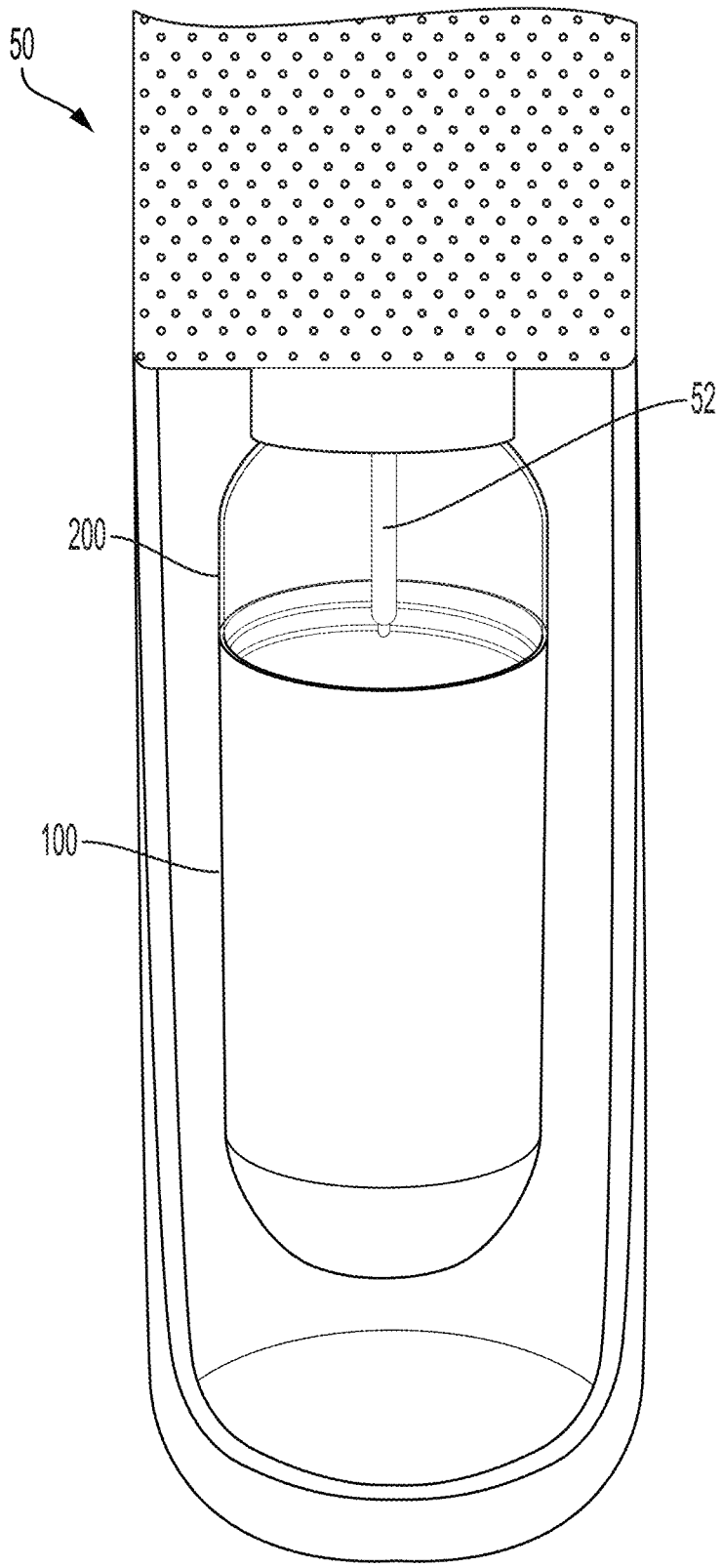
FIG. 15 is a carbonation system introducing carbonation into a container shown in FIG. 1.

Carbonation systems may introduce carbonation and cause an associated increase in pressure within container 10. For example, a carbonation system 50, as shown in FIG. 15, may attach to neck 230 and create a seal with opening 204, and then introduce carbon dioxide through opening 204 into container 10 to carbonate a beverage within container 10. In some embodiments, carbonation systems may include a carbonator wand, such as carbonator wand 52 shown in FIG. 15, that extends below the liquid fill line of the vessel 100 to diffuse carbon dioxide into the liquid held in vessel 100. Desirable internal pressures for carbonating a beverage in a reusable bottle, such as container 10, for example, can range between about 70 PSI and 115 PSI. Carbonation systems generally have safeguards to maintain pressure at that range to carbonate beverages held in the reusable bottle, but in order to further improve and provide redundancy for such safeguards, the geometry of the spatial interface defined between rim 240 of lid 200 and upper end 121 of vessel 100 provides a way to relieve pressure before internal pressure of container 10 reaches a threshold over-pressure, such as, for example, between 160 PSI and 205 PSI, that could risk unintentionally separating vessel 100 from lid 200.

The dimensions and geometry of rim 240 of lid 200 and upper end 121 of vessel sidewall 120 can be configured to permit movement of gasket 400 along selective portions of container 10 when the pressure of reservoir 102 reaches a threshold pressure level so that fluid communication is established between reservoir 102 and a section of gap 250 (e.g., venting zone 260), thereby allowing fluid held in container 10 to be vented through the section of gap 250. By venting fluid at a threshold pressure, the spatial interface between vessel 100 and lid 200 can allow container assembly 10 to be connected directly to a carbonator and receive carbonated gas in reservoir 102 without incurring the risk of an unintentional separation between the vessel 100 and lid 200 due to a pressure buildup.

Referring to FIG. 3, for example, in some embodiments, the spatial interface between vessel 100 and lid 200 can define a venting zone 260 extending circumferentially along a first portion of the perimeter of vessel 100 and lid 200 and a non-venting zone 270 extending circumferentially along a second portion of the perimeter of vessel 100 and lid 200. The first portion of the perimeter defining venting zone 260 can form a smaller percentage of the circumference of vessel 100 (e.g., about 10% of the circumference of vessel 100) compared to the second portion of the perimeter defining non-venting zone 270 (e.g., about 90% of the circumference of vessel 100). The first portion of the perimeter defining venting zone 260 can define an arc-shaped segment ranging between 20 degrees and 60 degrees of the circumference along container 10. For example, in some embodiments, the first portion of the perimeter defining venting zone 260 can span 20 degrees to 40 degrees of the circumference along container 10. In some embodiments, the first portion of the perimeter defining venting zone 260 can span 40 degrees to 60 degrees of the circumference along container 10. In some embodiments, the spatial interface between vessel 100 and lid 200 can define multiple venting zones 260 extending circumferentially along a portion of the perimeter of vessel 100 and lid 200 and multiple non-venting zones 270 extending circumferentially along a portion of the perimeter of vessel 100 and lid 200.

As shown, for example, in FIG. 6, in some embodiments, gap 250 along venting zone 260 can have a first vertical dimension 262 (e.g., a height defined in direction Y), and as shown in FIG. 9, gap 250 along non-venting zone 270 can have a second vertical dimension 272 that is smaller than the first vertical dimension 262 of venting zone 260. The vertical dimension of gap 250 can be set in a range between 0.5 mm and 2.5 mm. For example, in some embodiments, the first vertical dimension 262 can range from 1.0 mm to 2.0 mm. In some embodiments, the first vertical dimension 262 can range from 0.5 mm to 1.0 mm. In some embodiments, gap 250 along venting zone 260 can have a first radial dimension 264 (e.g., a length), and gap 250 along non-venting zone 270 can have a second radial dimension 274 that is smaller than the first radial dimension 264 of venting zone 260. In some embodiments, the difference in vertical dimension of gap 250 between venting zone 260 and non-venting zone 270 is implemented by gasket 400 having a thinner (in a vertical dimension) portion in venting zone 260 than in non-venting zone 270. This thinner portion may be formed, for example, as a cutout section of gasket 400.

By having a larger vertical dimension (e.g., first vertical dimension 262) and/or radial dimension (e.g., first radial dimension 264), the gap 250 along venting zone 260 includes more space that establishes a weaker seal between gasket 400 and corresponding portions of rim 240 and upper end 121 of vessel 100 compared to the seal established between gasket 400 and corresponding portions of rim 240 and upper end 121 of vessel 100 along non-venting zone 270. Because the seal between gasket 400 and corresponding portions of rim 240 and upper end 121 of vessel 100 is weaker along venting zone 260 compared to the seal established along non-venting zone 270, the spatial interface between vessel 100 and lid 200 allows at least a portion of gasket 400 to move out of its sealing position into the gap 250 along venting zone 260 at a lower internal pressure compared to the portion of gasket 400 disposed along non-venting zone 270.

Figure 7:
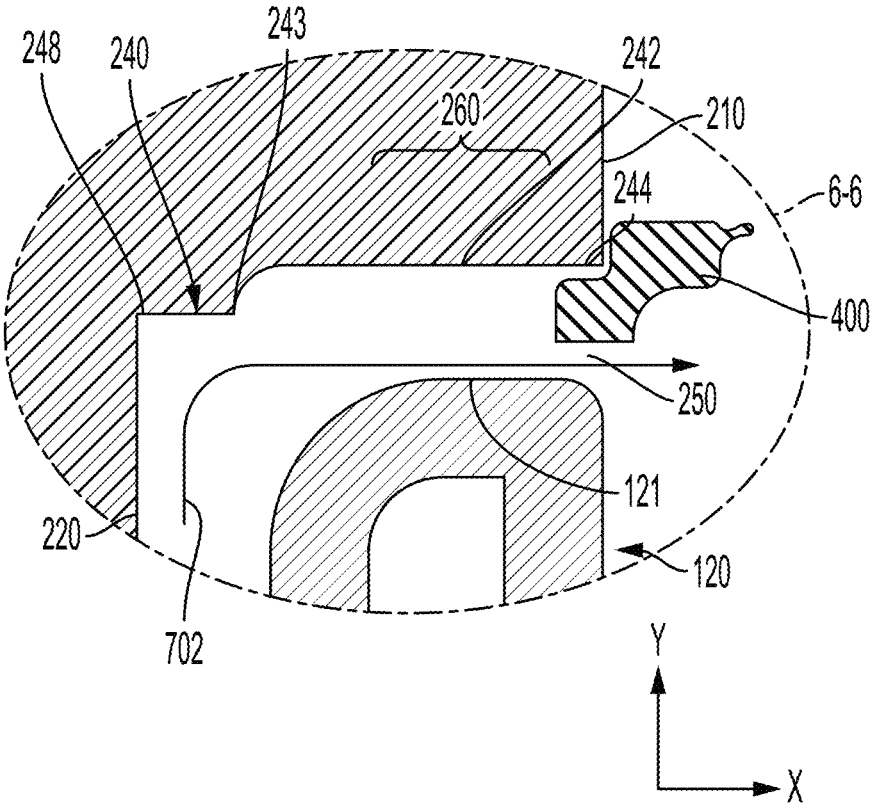
FIG. 7 is an enlarged cross-sectional view of a venting zone interface between the lid and the vessel taken along broken line 6-6 of FIG. 5.
Figure 8:
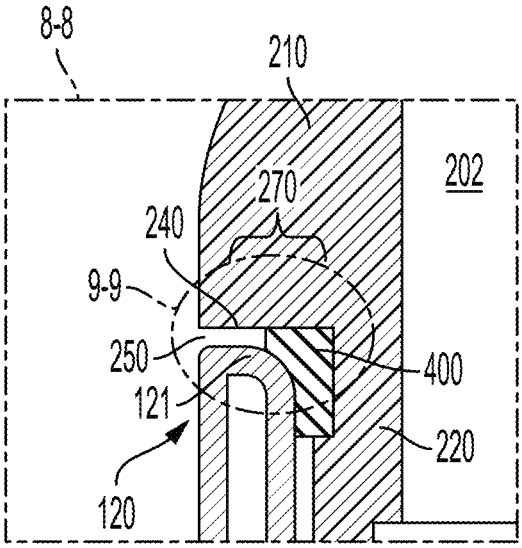
FIG. 8 is an enlarged cross-sectional view of a non-venting zone interface between the lid and the vessel taken along broken line 8-8 of FIG. 4.

For example, as pressure builds up in reservoir 102 (represented by arrow 620 in FIG. 6), the fluid pressure is applied against gasket 400 in a vertical direction Y toward lid opening 204 and a radial direction X away from the central longitudinal axis of the container 10. Accordingly, as shown in FIG. 7, for example, when reservoir 102 reaches a threshold pressure, the applied pressure moves a portion of gasket 400 along venting zone 260 into and through gap 250 to establish fluid communication between reservoir 102 and gap 250 along venting zone 260 such that fluid (e.g., carbonated gas) is vented along a pathway 702 through venting zone 260 to reduce the pressure of reservoir 102. At the same time, as shown in FIG. 9, the spatial interface between rim 240 and upper end 121 maintains gasket 400 in the sealed position along non-venting zone 270 when exposed at the same threshold pressure. Because only a portion of gasket 400 along venting zone 260 moves past the sealing position to vent fluid held within container 10, the spatial interface between vessel 100 and lid 200 relieves pressure before the internal pressure of container 10 rises to a level that can unintentionally separate vessel 100 from lid 200, thereby preserving the integrity of container 10.

In some embodiments, the dimensions, such as the vertical dimension, the radial dimension, or a circumferential dimension, of gap 250 along venting zone 260 can be tuned to relieve pressure at a predetermined pressure level below that which could result in an unintentional separation between vessel 100 and lid 200, yet above that which provides a desired carbonation level for a beverage. Increasing at least one of the vertical dimension, the radial dimension, and the circumferential dimension of gap 250 along venting zone 260 can decrease the threshold pressure level for actuating movement of gasket 400 into gap 250. Decreasing at least one of the vertical dimension, the radial dimension, and the circumferential dimension of gap 250 along venting zone 260 can increase the threshold pressure level for actuating movement of gasket 400 into gap 250.

In some embodiments, the predetermined pressure for actuating gasket 400 to move out of its seal position along venting zone 260 can be set in range between 100 PSI and 160 PSI, such as for example, 116 PSI to 145 PSI. Because the spatial interface between vessel 100 and lid 200 starts to relieve pressure at the predetermined threshold pressure (e.g., at a pressure between 100 PSI and 160 PSI), container 10 can still allow a carbonator to inject gas (e.g., carbon dioxide) into reservoir 102 at a suitable pressure (e.g., 70 PSI to 115 PSI) to dissolve gaseous carbon dioxide in the liquid held in reservoir 102, while having the safeguard to vent fluid before internal pressure reaches a level that poses risk of damaging (e.g., rupturing) container 10.

In some embodiments, the geometric shape of rim 240 along venting zone 260 can be configured to allow movement of gasket 400 in a radial direction and/or a vertical direction before the pressure of reservoir 102 reaches a level that poses risk of damaging container 10. The geometric shape of rim 240 of lid 200 can enlarge or reduce gap 250 along venting zone 260 to a predetermined vertical, radial, and/or circumferential dimension that provides a sufficient amount of space between upper end 121 and rim 240 to permit movement of gasket 400 at a predetermined threshold pressure, while still holding gasket 400 at a suitable pressure (e.g., 70 PSI to 115 PSI) to carbonate a beverage held in reservoir 102. For example, as shown in FIGS. 6 and 7, rim 240 can include a recess 242 located along venting zone 260 of the spatial interface between lid 200 and vessel 100. In some embodiments, recess 242 extends circumferentially along rim 240 to define the boundary of venting zone 260. Recess 242 can open into gap 250 such that the height of gap 250 is greater along recess 242. Recess 242 can be formed by any suitable process, such as, for example, by molding or post processing, to provide additional void space along venting zone 260.

In some embodiments, recess 242 can include a first end 243 located along rim 240 forward of lower sidewall 220 and a second end 244 located at about an outer edge of rim 240 proximate to upper sidewall 210. In some embodiments, the depth of recess 242 may vary along the radial direction such that the height of gap 250 varies in the radial direction along venting zone 260. For example, in some embodiments, recess 242 can define a first depth 245 proximate to first end 243 and a second depth 246 proximate to second end 244, where the second depth 246 is greater than the first depth 245. By reducing the depth of recess 242 proximate to first end 243 compared to the depth of recess 242 proximate to second end 244, the geometric shape of rim 240 provides sufficient support to maintain gasket 400 at the sealed position during a pressure range (e.g., 70 PSI-115 PSI) suitable for carbonation, while allowing movement of gasket 400 into gap 250 at a threshold pressure (e.g., 116 PSI-145 PSI) that prevents unintentional separation between vessel 100 and lid 200. In some embodiments, the depth of recess 242 may remain constant along the radial direction while providing sufficient support to maintain gasket 400 at the sealed position during a pressure range (e.g., 70 PSI-115 PSI) suitable for carbonation, while allowing movement of gasket 400 into gap 250 at a threshold pressure (e.g., 116 PSI-145 PSI) that prevents unintentional separation between vessel 100 and lid 200. The depth of recess 242 in the axial direction may range from 0.5 mm to 2.0 mm, such as 1.0 mm to 2.0 mm. The depth of recess 242 is configured to provide more space along gap 250, thereby establishing a weaker seal between gasket 400 and corresponding portions of rim 240 and upper end 121 of vessel 100 along venting zone 260.

In some embodiments, the length of the recess 242 in the radial direction can be tuned to allow movement of gasket 400 into gap 250 at a threshold pressure that prevents unintentional separation between vessel 100 and lid 200, while providing sufficient support to maintain gasket 400 at the sealed position during a pressure range (e.g., 70 PSI-115 PSI) suitable for carbonation. For example, rim 240 can have a seal seat surface 248 extending from the exterior surface of lower sidewall 220 to first end 243 of recess 242. When gasket 400 is disposed at the seal position, seal seat surface 248 is configured to engage gasket 400, thereby establishing a seal between gap 250 and reservoir 102 of vessel 100. When a portion of gasket 400 disposed along venting zone 260 moves through gap 250 in response to the reservoir 102 reaching the threshold pressure level, seal seat surface 248 is spatially separated from the gasket 400, thereby establishing fluid communication between reservoir 102 and gap 250. Increasing the length of seal seat surface 248 in the radial direction curtails the length of recess 242, which strengthens the seal between gasket 400 and rim 240 of lid 200, thereby raising the threshold pressure for actuating movement of the gasket 400 into gap 250. Decreasing the length of seal seat surface 248 in the radial direction increases the length of recess 242, which weakens the seal between gasket 400 and lid 200, thereby lowering the threshold pressure for actuating movement of the gasket 400 into gap 250. The length of seal seat surface 248 along venting zone 260 in the radial direction can range from 0.5 mm to 2.5 mm, such as from 1.0 mm to 2.0 mm.

Figure 10:
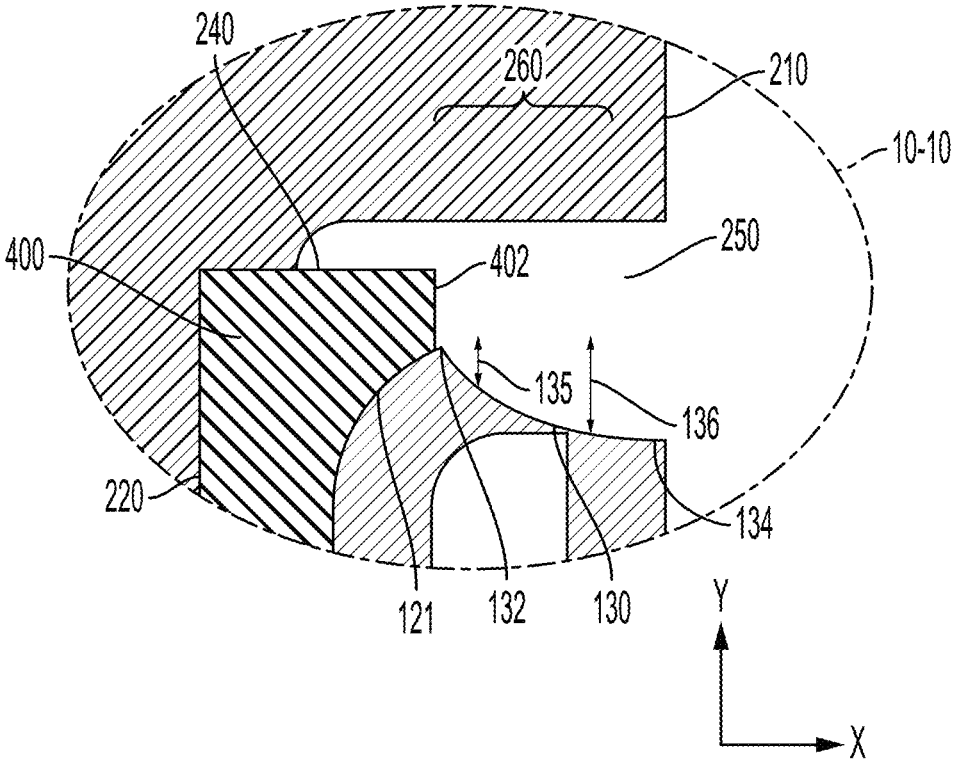
FIG. 10 is an enlarged cross-sectional view of a venting zone interface between the lid and the vessel taken along broken line 6-6 of FIG. 5.

In some embodiments, the geometric shape of upper end 121 along venting zone 260 can be configured to allow movement of gasket 400 in a radial direction and/or a vertical direction before the pressure of reservoir 102 reaches a level that poses risk of damaging container 10. The geometric shape of upper end 121 of vessel sidewall 120 can enlarge or reduce gap 250 along the venting zone 260 to a predetermined vertical, radial, and/or circumferential dimension that provides sufficient amount of space between upper end 121 and rim 240 to permit movement of gasket 400 at a predetermined threshold pressure, while still holding gasket 400 at a suitable pressure (e.g., 70 PSI to 115 PSI) to carbonate a beverage held in reservoir 102. For example, as shown in FIG. 10, upper end 121 can include a recess 130 located along venting zone 260 of the spatial interface between lid 200 and vessel 100. In some embodiments, recess 130 can be formed by using any suitable process, such as, for example, by molding or post processing, to provide additional void space along venting zone 260.

In some embodiments, recess 130 can include a first end 132 located along upper end 121 forward of the interior surface of vessel sidewall 120 and a second end 134 located at about the exterior surface of vessel sidewall 120. In some embodiments, the depth of recess 130 may vary along the radial direction such that the height of gap 250 varies in the radial direction along venting zone 260. For example, in some embodiments, recess 130 can define a first depth 135 proximate to first end 132 and a second depth 136 proximate to second end 134, where the second depth 136 is greater than the first depth 135. By reducing the depth of recess 130 proximate to first end 132 compared to the depth of recess 130 proximate to second end 134, the geometric shape of upper end 121 provides sufficient support to maintain gasket 400 at the sealed position during a pressure range (e.g., 70 PSI-115 PSI) suitable for carbonation, while allowing movement of gasket 400 into gap 250 at a threshold pressure (e.g., 116 PSI-145 PSI) that prevents unintentional separation between vessel 100 and lid 200. Locating recess 130 along upper end 121 of vessel sidewall 120 minimizes the amount of liquid displaced in the vertical orientation, thereby configuring container 10 to prevent a rapidly cooling liquid from freezing as the pressure in the container 10 is reduced during venting.

In some embodiments, as shown in FIG. 11, for example, thread 222 of lower sidewall 220 can include breaks 223 that define a flow path 224 along lower sidewall 220. The flow path 224 can extend in a vertical direction and traverse thread 222. The breaks 223 of thread 222 can be aligned with venting zone 260 defined along rim 240 so that fluid may escape from reservoir 102 to venting zone 260 at a faster rate. By increasing the flow rate of fluid from reservoir 102 to venting zone 260, the breaks 223 along thread 222 can expedite the response time for container 10 to relieve pressure at venting zone 260 and lower the threshold pressure for actuating movement of gasket 400 along venting zone 260. The flow path 224 can ensure movement of gasket 400 along venting zone 260 before internal pressure disrupts the threaded connection between vessel 100 and lid 200. In some embodiments, sidewall 220 can include a through hole that is aligned with venting zone 260 defined along rim 240 to increase the flow rate of fluid escaping reservoir 102 to venting zone 260.

Figure 16:
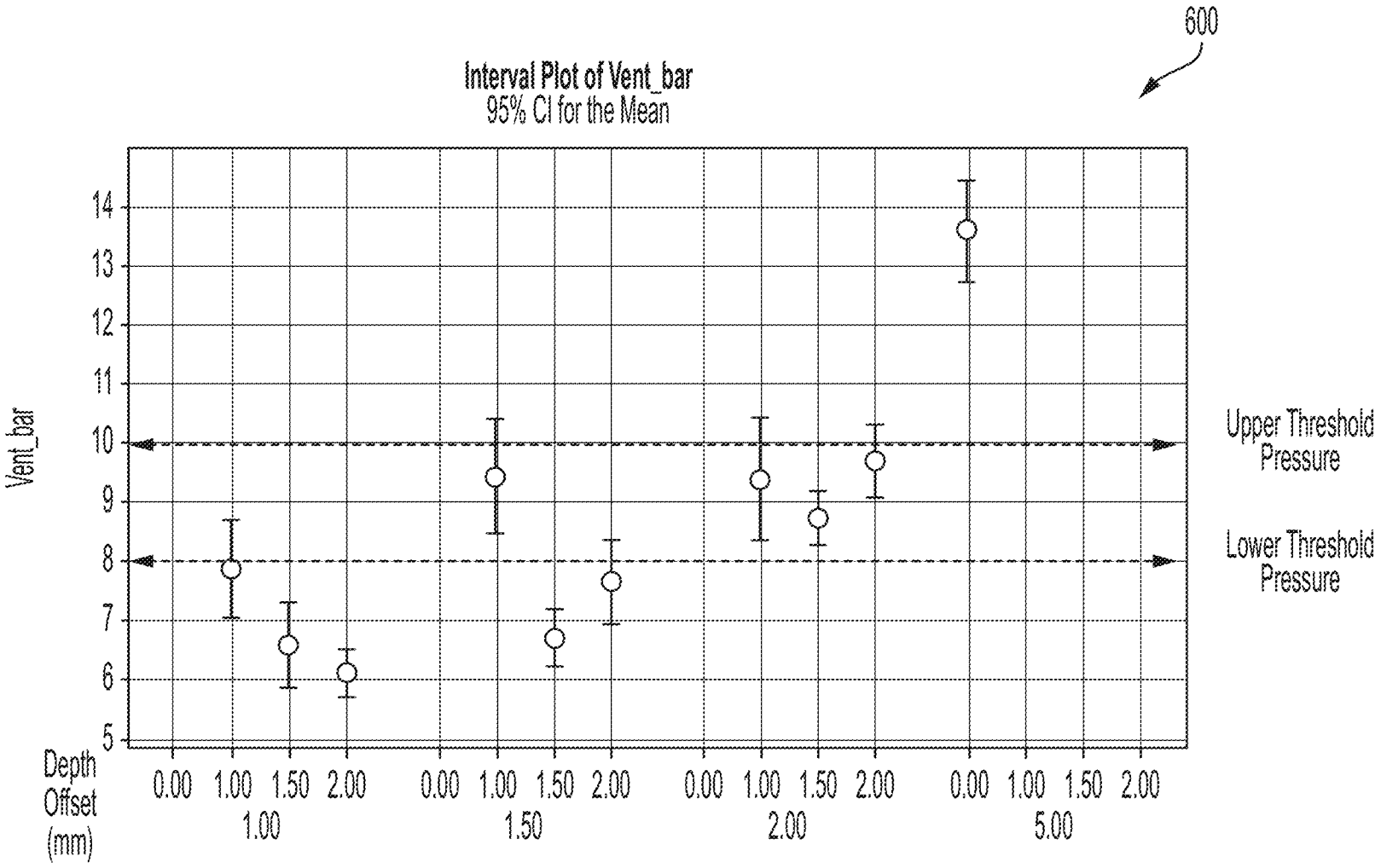
FIG. 16 is a plot showing a relationship between a range of pressure for actuating gasket movement in a container shown in FIG. 1 and the geometry of the rim of a lid for a container shown in FIG. 1.

FIG. 16 shows a plot 600 charting the threshold pressures for actuating gasket movement according to various embodiments of prototype lids tested during the development of container 10. As shown along the x-axis of plot 600, the geometric shape of rim 240 of various lids were altered by tuning the length of seal seat surface 248 (i.e., indicated by "Offset" in plot 600 of FIG. 15) and the depth of recess 242 (i.e., indicated by "Depth" in plot 600 of FIG. 15) along the venting zone 260. Tuning the length of seal seat surface 248 and the depth of recess 242 changes the volume of void space along venting zone 260 to weaken or strengthen the seal strength of gasket interface between rim 240 and lower sidewall 220 of lid 200, so that lid prototypes actuate gasket movement at different pressures. During the testing procedure, the prototype lids 200 listed in plot 600 were subjected to a range of pressures shown along the vertical axis of plot 600. By tuning the length of seal seat surface 248 and the depth of recess 242 along the venting zone 260 to particular parameters, embodiments of lid 200 achieved actuation of gasket movement at a range of pressures, such as 116 PSI to 145 PSI (i.e., 8 bar to 10 bar), that prevents unintentional separation between vessel 100 and lid 200, while keeping gasket 400 in a sealed position at a suitable pressure, such as 72 PSI to 102 PSI (i.e., 5 bar to 7 bar) to dissolve gaseous carbon dioxide in the liquid held in reservoir 102. In comparison, a prototype lid that included a rim 240 without a recess (e.g., indicated by marker at a depth=0.0 mm, offset=5.0 mm in plot 600 of FIG. 15) did not permit gasket movement until a pressure, such as 203 PSI (i.e., 14 bar), that poses risk of unintentional separation of vessel 100 from lid 200. The range of pressures shown between the upper threshold pressure and lower threshold pressure lines shown in plot 600 of FIG. 16 corresponds to a threshold pressure range suitable for relieving pressure adequately before the internal pressure of container 10 reaches a pressure that could risk unintentional separation of vessel 100 from lid 200, while still maintaining an internal pressure suitable for diffusing carbonation in container 10.

It is to be appreciated that the Detailed Description section, and not the Brief Summary and Abstract sections, is intended to be used to interpret the claims. The Summary and Abstract sections may set forth one or more but not all exemplary embodiments as contemplated by the inventors, and thus, are not intended to limit the present embodiments and the appended claims in any way.

The foregoing description of the specific embodiments will so fully reveal the general nature of the inventions that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the claims and their equivalents.

What is claimed is:

1. A beverage container comprising:

a vessel;

a lid removably coupled to the vessel, the lid comprising a drinking spout defining a passage for dispensing liquid into and out of an internal reservoir of the vessel, and a circumferential rim at an interface with the vessel, wherein the rim is separated from the vessel by a gap, wherein the gap is open to the atmosphere outside the container; and an annular gasket disposed at a sealing position between the vessel and the lid to seal the internal reservoir of the vessel from the gap, wherein in response to the internal reservoir of the vessel reaching a threshold pressure, a portion of the gasket moves from the sealing position through the gap such that fluid held in the reservoir is vented through the gap to reduce the pressure of the reservoir.

2. The beverage container of claim 1, wherein the rim comprises a recess extending circumferentially along a first portion of the rim, and the recess forms a portion of the gap and defines a venting zone extending circumferentially along the first portion of the rim, wherein the portion of the gasket is located along the venting zone such that the fluid vented through the gap is directed through the venting zone.

3. The beverage container of claim 2, wherein the recess comprises a first end located forward of an inner edge of the rim and a second end located at an outer edge of the rim.

4. The beverage container of claim 3, wherein the recess has a first height proximate to the first end and a second height proximate to the second end, and the second height is greater than the first height.

5. The beverage container of claim 1, wherein in response to the internal reservoir of the vessel reaching the threshold pressure, a second portion of the gasket remains in the sealed position along a second portion of the rim to maintain the seal between the reservoir of the vessel and the gap along the second portion of the rim.

6. The beverage container of claim 1, wherein the lid comprises an upper sidewall and a lower sidewall together defining a chamber, and the rim extends in a radial direction between the lower sidewall and the upper sidewall, and wherein the upper sidewall extends above a sidewall of the vessel, and the lower sidewall projects into the vessel such that the chamber of the lid opens into the reservoir of the vessel.

7. The beverage container of claim 6, wherein the lower sidewall comprises a helical-shaped thread configured to engage the sidewall of the vessel, and the thread includes a plurality of breaks defining a fluid passage.

8. The beverage container of claim 6, wherein the drinking spout is projected from an upper end of the upper sidewall of the lid, and the passage of the drinking spout opens into the chamber of the lid.

9. The beverage container of claim 1, wherein the vessel is formed of stainless steel, and the lid is formed of a polymer-based material.

10. The beverage container of claim 1, wherein the lid is transparent.

11. A container assembly comprising:

a vessel;

a lid removably coupled to the vessel, the lid comprising:

an upper sidewall and a lower sidewall defining a chamber, wherein the upper sidewall extends above a sidewall of the vessel, and the lower sidewall projects into the vessel such that the chamber of the lid opens into the reservoir of the vessel, and a circumferential rim extending in a radial direction between the upper sidewall and the lower sidewall and located at an interface with the vessel, wherein the rim is separated from the vessel by a gap, wherein the gap is open to the atmosphere outside the container; and an annular gasket disposed at a sealing position between the vessel and the lid to seal an internal reservoir of the vessel from the gap, wherein in response to the internal reservoir of the vessel reaching a threshold pressure, a portion of the gasket moves from the sealing position through the gap such that fluid held in the reservoir is vented through the gap to reduce the pressure of the reservoir.

12. The container assembly of claim 11, wherein the interface defines a venting zone extending circumferentially along a first portion of the interface and a non-venting zone extending circumferentially along a second portion of the interface, and the gap along the venting zone is greater in a vertical direction than the gap along the non-venting zone, wherein the portion of the gasket is located along the venting zone such that the fluid vented through the gap is directed through the venting zone.

13. The container assembly of claim 12, wherein the rim comprises a recess located along the venting zone of the interface, and the recess comprises a first end located forward of an inner edge of the rim and a second end located at an outer edge of the rim.

14. The container assembly of claim 13, wherein the recess has a first height proximate to the first end and a second height proximate to the second end, and the second height is greater than the first height.

15. The container assembly of claim 12, wherein in response to the internal reservoir of the vessel reaching the threshold pressure, a second portion of gasket remains in the sealed position along the non-venting zone of the interface to maintain the seal between the reservoir of the vessel and the gap along the non-venting zone.

16. The container assembly of claim 11, wherein the lower sidewall comprises a helical-shaped thread configured to engage the sidewall of the vessel, and the thread includes a plurality of breaks defining a fluid passage.

17. The container assembly of claim 11, wherein the vessel comprises a bottom, and the sidewall of the vessel extends from the bottom defining the reservoir.

18. The container assembly of claim 17, wherein an upper end of the sidewall of the vessel comprises a recess located along the venting zone of the interface, and the recess comprises a first end located forward of an interior surface of the sidewall of the vessel and a second end located at an exterior surface of the sidewall of the vessel.

19. The container assembly of claim 18, wherein the recess defines a first height proximate to the first end and a second height proximate to the second end, and the second height is greater than the first height.

20. The container assembly of claim 11, wherein the vessel is comprised of a metal-based material, and the lid is comprised of a transparent polymer-based material.

* * * * *